United States Patent [19]

Bassi

[11] Patent Number: 4,589,149

[45] Date of Patent: May 20, 1986

[54] HYGIENIC DEVICE FOR COVERING WATER-CLOSET RING-SHAPED SEATS AND THE LIKE

[76] Inventor: Giuseppe Bassi, 23, Via Caminate, Bibbona, Livorno, Italy

[21] Appl. No.: 702,497

[22] Filed: Feb. 19, 1985

Related U.S. Application Data

[63] Continuation of Ser. No. 503,502, Jun. 13, 1983, abandoned.

[30] Foreign Application Priority Data

Jun. 15, 1982 [IT] Italy ..... 17407 A/82

[51] Int. Cl.[4] ..... A47K 13/14

[52] U.S. Cl. ..... 4/242

[58] Field of Search ..... 4/234, 242–247; 152/52 M

[56] References Cited

U.S. PATENT DOCUMENTS

| | | | |
|---|---|---|---|
| 963,792 | 7/1910 | Miller | 4/243 |
| 1,278,381 | 9/1918 | Power | 4/243 |
| 1,362,671 | 12/1920 | Budge | 4/242 X |
| 1,632,645 | 6/1927 | DeLuna | 4/243 X |
| 1,830,344 | 11/1931 | Akesson | 4/243 |
| 1,979,634 | 11/1934 | Nelson | 4/242 |
| 3,102,276 | 9/1963 | Warnberg | 4/242 |
| 4,227,267 | 10/1980 | Robertson | 4/242 X |
| 4,352,214 | 10/1982 | Belz | 4/243 |

FOREIGN PATENT DOCUMENTS

| | | | |
|---|---|---|---|
| 10563 | of 1909 | United Kingdom | 4/243 |
| 1387994 | 3/1973 | United Kingdom | 4/242 |
| 1339743 | 12/1973 | United Kingdom | 4/242 |

*Primary Examiner*—Charles E. Phillips

*Attorney, Agent, or Firm*—McGlew and Tuttle

[57] ABSTRACT

A hygienic covering for the bearing surface of an annular seat of a water-closet, consisting of a layer of paper, plastified paper or the like in the form of a cylindrical ring including two annular resilient edges provided with elastic bands, for providing a covering, can be positioned on said surface of seat, in order to be engaged with one resilient edge with the elastic band at the outer edge and to be kept substantially tensioned above the surface of the seat by means of the other resilient edge with the elastic band.

2 Claims, 9 Drawing Figures

HYGIENIC DEVICE FOR COVERING WATER-CLOSET RING-SHAPED SEATS AND THE LIKE

This is a continuation of application Ser. No. 503,502 filed June 13, 1983 now abandoned.

FIELDS OF THE INVENTION

The present invention relates to a device for covering water-closet seats.

Differently shaped sheets of paper are now commercially available for use on water-closet seats where they are simply applied, so that they tend to easily slip away.

The hygienic device which is the object of this invention eliminates this trouble, and achieves effective hygienic protection.

SUMMARY OF THE INVENTION

The hygienic device according to the invention—which serves to cover the bearing surface of an annular seat for a water-closet or other similar apparatus—consists of a thin layer of ring-shaped flexible material with the two annular edges which are made resilient. Said device can be positioned on said surface so that it engages with one of its resilient edges at the outer edge of said surface and can be maintained substantially tensioned above said surface by means of the outer resilient edge. Said layer can be made to have a substantially cylindrical shape.

BRIEF DESCRIPTION OF THE DRAWINGS

The drawings shows examples of embodiments and applications.

DESCRIPTION OF THE PREFERRED EMBODIMENTS

According to the drawings, the device is formed with a cylindrical annular strip 1 having a diameter of about 50–60 cm., and a height of about 15–25 cm., and is provided at the two annular edges with two respective elastic bands 3A and 3B which cause their wrinkling and allow their resilient expansion until they reach the size of the strip. The elastic bands 3A, 3B can be made of comparatively thin filiform rubber material.

Figure 1:
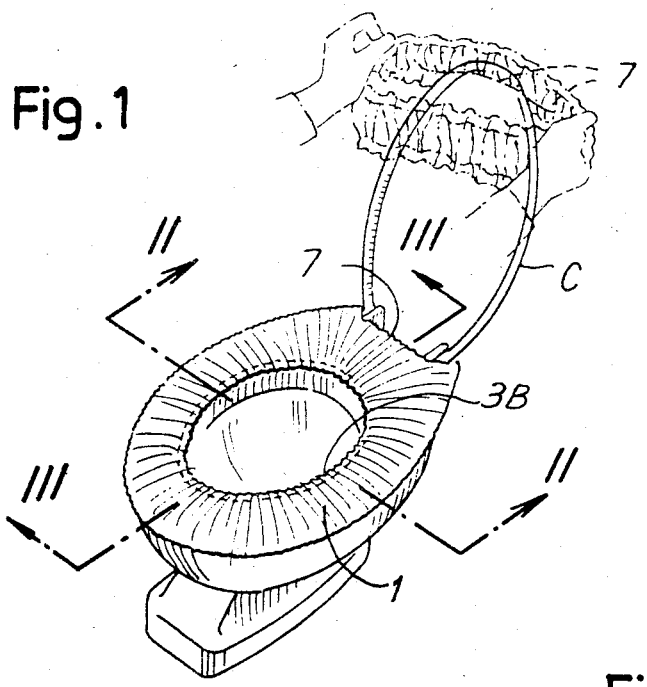
FIGS. 1, 2 and 3 are a perspective views of a water-closet and partly sectional views along II—II and III—III of FIG. 1 showing the covering device.
Figure 2:
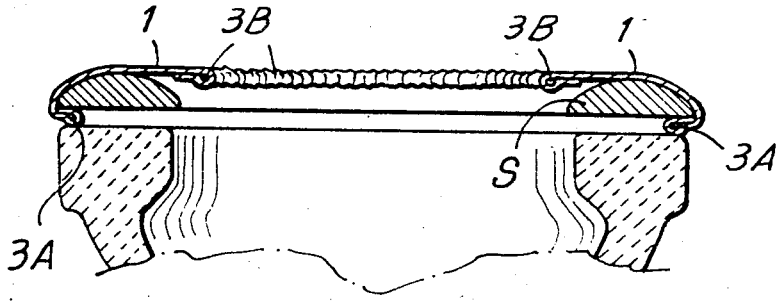
Figure 3:
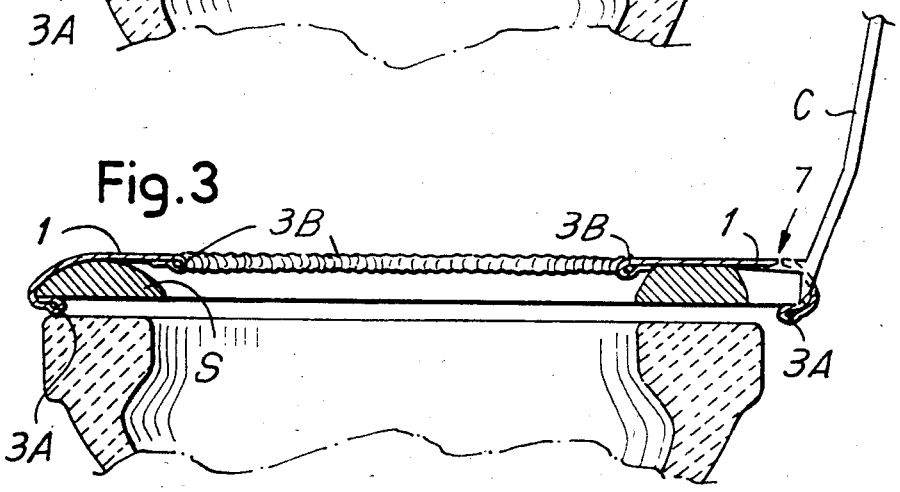
Figure 4:
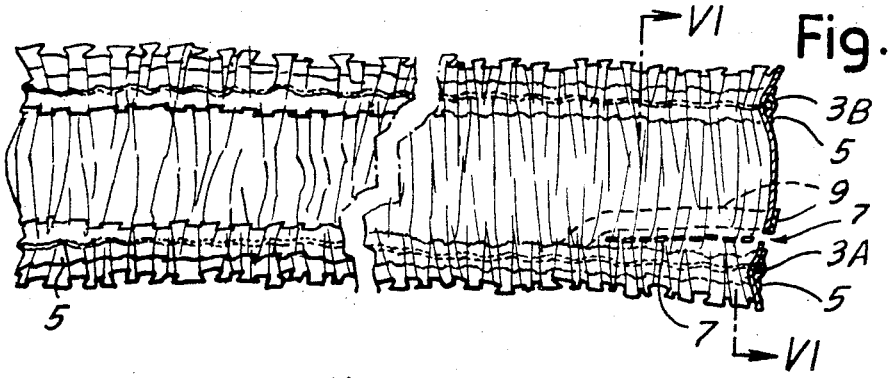
FIGS. 4 and 5 illustrate two embodiments of the device, partly sectioned.
Figure 5:
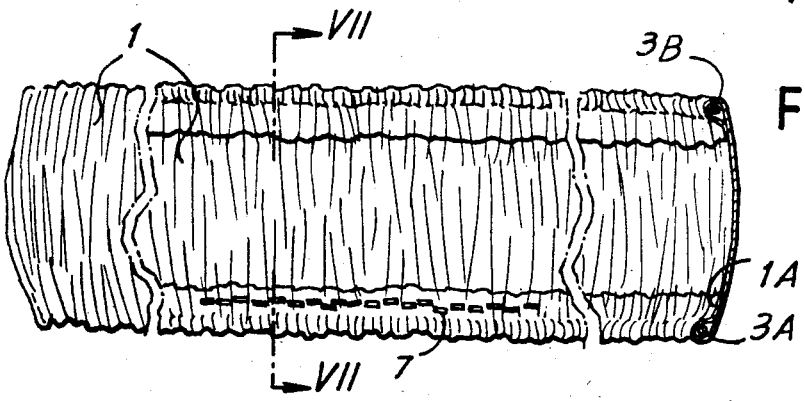
Figure 6:
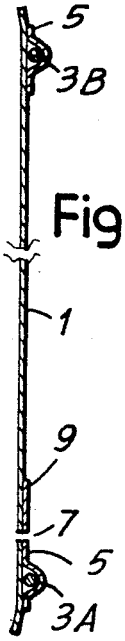
FIGS. 6, 7 and 8 illustrate two sectional magnified details along VI—VI of FIG. 4 and VII—VII of FIG. 5 and a magnified detail of FIG. 7.
Figure 7:
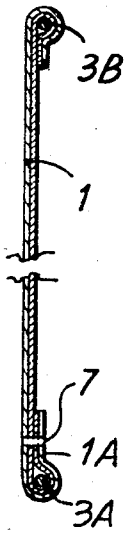
Figure 8:
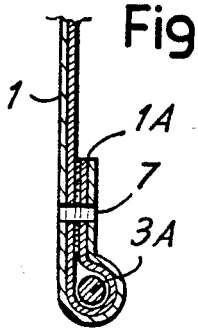

The strip 1 can be made of plastified paper which is sufficiently water-proof; in this case the elastic bands 3A and 3B can be engaged (see FIGS. 5, 7, 8) within the folded edges 1A, which can be directly hot-welded between the plastified surfaces, coming into contact and on the elastic band; it is also possible to weld the tensioned elastic band directly on the film. The same arrangement can be adopted when the layer is made of a film of thermoplastic resin. The strip 1 can be made of paper; in this case the elastic bands 3A and 3B can be engaged (see FIGS. 4 and 6) by means of adhesive tapes 5. The layer 1 can be made also of other materials, such as fabric, woven-non-woven, covered also with downy flocks.

For use on a annular seat S for water-closet, the cylindrical strip 1 is mounted on the surface of the seat S by tensioning one of the two elastic bands—in the example the elastic band 3A—and engaging it below the outer edge of the seat S; the other elastic band 3B urges the respective edge toward the interior, so that the more or less wrinkled strip 1 is fixedly arranged on the seat S leaving a wide central space.

The covering fits seats S of most usual dimensions, due to its resiliency and sizes which enable an easy arrangment.

When one sits down, one does not come in contact with the seat S but only with the material of the strip 1.

If the paper is plastified only on one face, it may be more comfortable to arrange the non-plastified surface upward.

When the seat S is combined with a lid C, which may hamper the coupling of the hygienic covering, the outer edge can be engaged around, i.e., behind the rised lid. For this purpose a perforation line 7 of suitable length can be provided in the vicinity of the edge with the outer elastic band 3A and therealong; by tearing the material along said line 7, a slot is obtained for mounting the covering through the lid C until it reaches the seat S. The perforation line 7 can be preformed (FIGS. 7 and 8) at or adjacent the folded and welded edge 1A or, alternatively, between the adhesive tape 5 and a further reinforcing contiguous adhesive tape 9 (see FIGS. 4 and 6), which at its ends overlaps the contiguous adhesive tape 5.

The covering 1 can be easily and steadily mounted and can be removed very easily; since it is cheap, it can be utilized for a single use for hygienic purposes.

Figure 9:
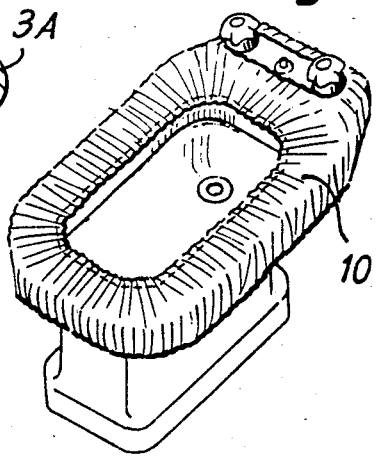
FIG. 9 shows a possible application on a bidet.

A similar hygienic covering can be used to cover directly the edge of the china water-closet bowl. A suitably shaped covering 10 can be used also to cover the edge of a bidet (FIG. 9); in this case a slot analogous to that which can be formed by tearing along the perforated line 7, can enable the mounting around the bidet faucets.

The above described manufactured articles can be made available in multiple packings, and can be suitably sterilized and/or perfumed.

What is claimed is:

1. A disposable cover for an annular toilet seat having an outer periphery and an inner rim spaced inwardly of the outer periphery and extending around an opening of the seat, consisting essentially of: a cylindrical ring of disposable flexible wrinkled cover material having substantially identical parallel opposite annular edges; an endless elastic band extending along and secured to each opposite edge, each of said bands being of substantially the same length; said edges of said cover and said elastic bands being of a size such that one of said bands is engageable around the outer pheriphery of the toilet seat and the other is stretched over the inner rim of the toilet seat when it is applied thereto; said cover material being a plastified paper having edges which are folded and secured to surround the respective elastic bands and having a line of perforations defining when broken an opening between the edges of said cover for accommodating a toilet part.

2. A disposable cover according to claim 1, including a reinforcing member disposed along a periphery of the opening.

* * * * *